US006820733B1

(12) United States Patent
Werner, Jr.

(10) Patent No.: US 6,820,733 B1
(45) Date of Patent: Nov. 23, 2004

(54) SIDE DUMP COMPATIBLE MATERIAL CONVEYOR SYSTEM

(76) Inventor: Philip F. Werner, Jr., 129 E. 2nd St., Hastings, NE (US) 68902-1087

( * ) Notice: Subject to any disclaimer, the term of this patent is extended or adjusted under 35 U.S.C. 154(b) by 0 days.

(21) Appl. No.: 10/435,066

(22) Filed: May 9, 2003

(51) Int. Cl.[7] ..... B65G 47/26
(52) U.S. Cl. ..... 198/457.01; 404/101; 414/334
(58) Field of Search ..... 404/101, 84.1; 198/570, 576, 457.01, 457.03, 457.05; 298/18; 414/334, 340, 345, 346

(56) References Cited

U.S. PATENT DOCUMENTS 3,966,343 A * 6/1976 Dick et al. ..... 404/101
4,074,802 A * 2/1978 Hudis ..... 198/315
4,379,669 A * 4/1983 Wilson ..... 414/21
4,494,798 A * 1/1985 Bailey ..... 298/17.6
5,000,615 A * 3/1991 Murray ..... 404/75
5,123,519 A * 6/1992 Reninger et al. ..... 198/508
5,377,810 A * 1/1995 Lehtonen et al. ..... 198/303
5,494,150 A * 2/1996 McDonell et al. ..... 198/524
5,515,961 A * 5/1996 Murphy et al. ..... 198/302
5,816,388 A * 10/1998 Bowman ..... 198/836.1
6,332,736 B1 * 12/2001 Cape et al. ..... 404/75
6,464,426 B1 * 10/2002 Girouard ..... 404/101

* cited by examiner

*Primary Examiner*—Richard Ridey
(74) *Attorney, Agent, or Firm*—Adam H. Jacobs

(57) ABSTRACT

A side dump compatible material conveyor system operable to function with a material placer and spreader unit includes a conveyor support frame and a first conveyor belt mounted on the conveyor support frame. A second conveyor belt includes outer and inner ends, the second conveyor belt mounted on the conveyor support frame and extending generally perpendicular to the first conveyor belt with the outer end of the second conveyor belt positioned adjacent one end of the first conveyor belt such that material moved on the first conveyor belt is transferred to the second conveyor belt. Finally, the inner end of the second conveyor belt is positionable in front of a material placer and spreader unit such that material moved on the second conveyor belt towards the inner end thereof is deposited in front of the material placer and spreader unit for placing and spreading of the material.

14 Claims, 4 Drawing Sheets

SIDE DUMP COMPATIBLE MATERIAL CONVEYOR SYSTEM

BACKGROUND OF THE INVENTION

1. Technical Field

The present invention relates to material conveyor systems and, more particularly, to a side dump compatible material conveyor system which includes a conveyor support frame, a first conveyor belt mounted on the conveyor support frame, a second conveyor belt mounted on the conveyor support frame extending generally perpendicular to the first conveyor belt with the first conveyor belt extending generally parallel to the direction of travel of the material placer and spreader unit on which it is mounted such that a side dump trailer may travel alongside the material conveyor system and dump material held within the dump tub of the side dump trailer onto the first conveyor belt for transference of the material to the material placer and spreader unit.

2. Description of the Prior Art

There are numerous conveyor systems which have been adapted for use with material placing and spreading devices such as those used in connection with the production of finished roadway surfaces and sub-surfaces, such as concrete and asphalt paving machines. A typical conveyor system of the prior art is shown in FIG. 1 as including a single conveyor belt extending perpendicularly from the placer/spreader unit. Rear discharge trucks approach and dump their materials onto the conveyor belt. However, each time a truck unloads material onto the belt, the belt must be either extended out into the traveled way, or be lowered from a raised position to accept the material from the truck. It is clear that this method takes time due to the belt being extended, then retracted, or lowered then raised. This method also blocks the travel way any time the belt is not in the retracted or raised position.

It is true that this system has performed adequately for a number of years, so long as the amount of material being dumped onto the conveyor belt was strictly controlled and the dump body performing the dump was of a standard dump body type, i.e. a rear dump type of dump body. As can be seen from the illustration of FIG. 1, however, there are numerous deficiencies with this type of arrangement, not the least of which is that the speed of the placer/spreader unit and dump body must be specifically matched or the material being dumped will miss the conveyor belt or the conveyor belt will impact the rear of the dump body causing damage to both units. Furthermore, because the amount of material which can be dumped onto the conveyor belt is restricted by the width of the conveyor belt and the width of the dump body, the transfer of material from the dump body to the placer/spreader unit is slowed, thus retarding the application of the material to the location where it is being placed by the placer/spreader unit. There is therefore a need for an improved material conveyor system for use with placer/spreader units which will increase the efficiency of transfer of material from the dump body to the placer/spreader unit, yet do so in a safe and easily controllable manner.

Numerous types of systems and devices for moving and unloading material are shown in the prior art, including Lambert, U.S. Pat. No. 4,063,656, Lutz, U.S. Pat. No. 5,405,215, and Suhr, U.S. Pat. No. 3,234,862. However, each of these devices include inherent deficiencies which do not completely solve the above-cited problems found in the prior art. Specifically, none of the devices found in the prior art provide a solution to the use of side dump trailers with placer/spreader units. Briefly, a side dump trailer is a longitudinally extended trailer having pivot joints along each side thereof such that the axis of rotation of the dump tub is generally parallel with the frame of the side dump trailer as opposed to generally perpendicular as is the case with rear dump bodies and trailers. The use of side dump trailers is becoming ever more popular as their generally low cost of operation and ease of use allow them to excel at a variety of tasks. However, there is currently no method by which a side dump trailer may easily transfer material held within the dump tub of the side dump trailer to the placer/spreader unit except by merely dumping the material in front of the placer/spreader unit so that the placer/spreader unit passes over the material and spreads it according to the desired spreading and placing characteristics. It has been found that in many situations it is impossible for the side dump trailer to travel in front of the placer/spreader unit due to the previously prepared bed over which the placer/spreader unit is traveling, as the passage of the side dump trailer over that bed will degrade the condition of the bed and render it useless for its intended purpose. There is therefore a need for a material conveyor system which is compatible for use with side dump trailers for transferring material to a placer/spreader unit.

Therefore, an objective of the present invention is to provide a side dump compatible material conveyor system for use with a material placer and spreader unit.

Another object of the present invention is to provide a side dump compatible material conveyor system which includes a conveyor support frame on which first and second conveyor belts are mounted, the frame mounted to the placer/spreader unit or traveling adjacent thereto with the first conveyor belt extending generally parallel to the direction of travel of the placer/spreader unit and the second conveyor belt extending between the end of the first conveyor belt and the area directly in front of the placer/spreader unit.

Another object of the present invention is to provide a side dump compatible material conveyor system which includes the first conveyor belt on which a side dump trailer may dump its load while traveling parallel thereto such that a greater quantity of material may be transferred in a shorter period of time to the conveyor belt and thus to the placer/spreader unit thereby increasing the efficiency of application of the material by the placer/spreader unit.

Another object of the present invention is to provide a side dump compatible material conveyor system which is usable with side dump trailers as they have increased payload capacity of up to twenty-four (24) tons as opposed to the approximate sixteen (16) ton capacity of rear dump units, thus allowing for a substantial increase in productivity with use of the same number of hauling units.

Another object of the present invention is to provide a side dump compatible material conveyor system which includes a first conveyor belt having a length greater than the length of an associated side dump trailer dump tub such that minor variations in relative speed between the material conveyor system and the side dump trailer may be easily accommodated and will not result in spillage and loss of the material during transfer of the material from the side dump trailer to the material conveyor system of the present invention.

Finally, an object of the present invention is to provide a side dump compatible material conveyor system which is relatively simple and durable in construction and is safe and efficient in use.

SUMMARY OF THE INVENTION

The present invention provides a side dump compatible material conveyor system operable to function with a material placer and spreader unit which includes a conveyor support frame and a first conveyor belt mounted on the conveyor support frame. A second conveyor belt includes outer and inner ends, the second conveyor belt mounted on the conveyor support frame and extending generally perpendicular to the first conveyor belt with the outer end of the second conveyor belt positioned adjacent one end of the first conveyor belt such that material moved on the first conveyor belt is transferred to the second conveyor belt. Finally, the inner end of the second conveyor belt is positionable in front of a material placer and spreader unit such that material moved on the second conveyor belt towards the inner end thereof is deposited in front of the material placer and spreader unit for placing and spreading of the material.

The side dump compatible material conveyor system as thus described provides several advantages not found in the prior art. For example, because the first conveyor belt extends generally parallel with the direction of travel of the material placer and spreader unit, a side dump trailer may travel alongside the placer and spreader unit while dumping material onto the first conveyor belt, the material then being transferred to the material placer and spreader unit as described above. Also, even in situations where the side dump trailer, the side dump compatible material conveyor system or both are stationary during the dump, the extended length of the first conveyor belt permits the material placer and spreader to continue moving forward during the dump to generally prevent the dumping of excessive material in one location on the first conveyor belt. Furthermore, because the first and second conveyor belts are mounted together on a frame separate from the material placer and spreader unit, the side dump compatible material conveyor system may be mounted on the material placer and spreader unit or may be positioned separately therefrom to permit use of a single side dump compatible material conveyor system with a number of different material placer and spreader units, thus increasing efficiency and reducing the number of material conveyor systems needed for installation of roads and road bed materials. The present invention also is usable for the stockpiling of material in transferring from the side dump trailer to the area for stockpiling. Finally, because the first conveyor belt extends alongside the material placer and spreader unit and preferably has a length exceeding the length of the side dump trailer dump tub, minor variations in speed between the material placer and spreader unit and the side dump trailer will not result in loss of material during the material transfer so long as the directions of travel of the material placer and spreader unit and side dump trailer remain generally parallel. It is thus seen that the side dump compatible material conveyor system of the present invention provides a substantial improvement over those devices found in the prior art.

DESCRIPTION OF THE PREFERRED EMBODIMENT

Figure 1:
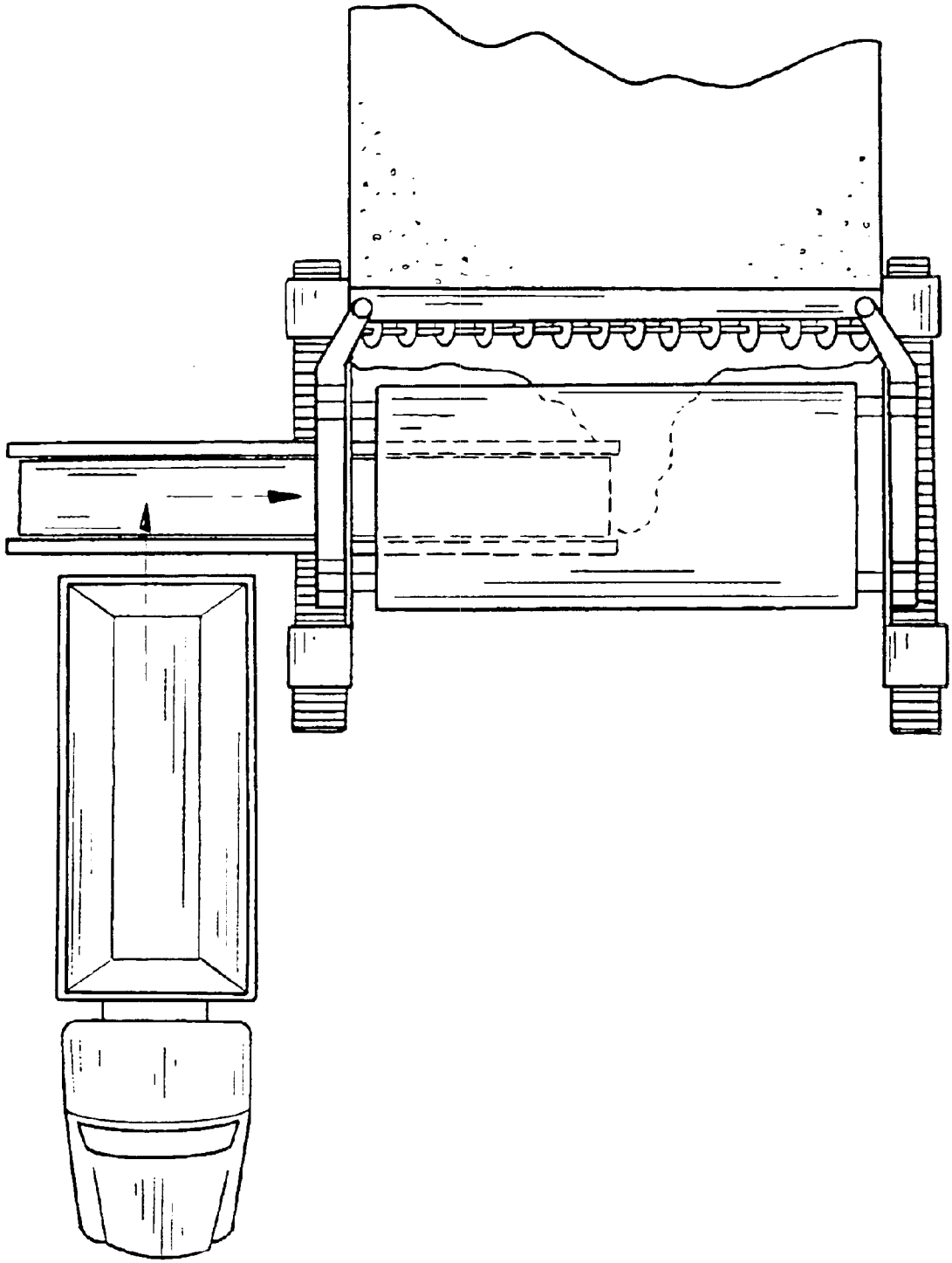
FIG. 1 (PRIOR ART)
FIG. 1 is a top plan view of a conveyor belt system found in the prior art.
Figure 2:
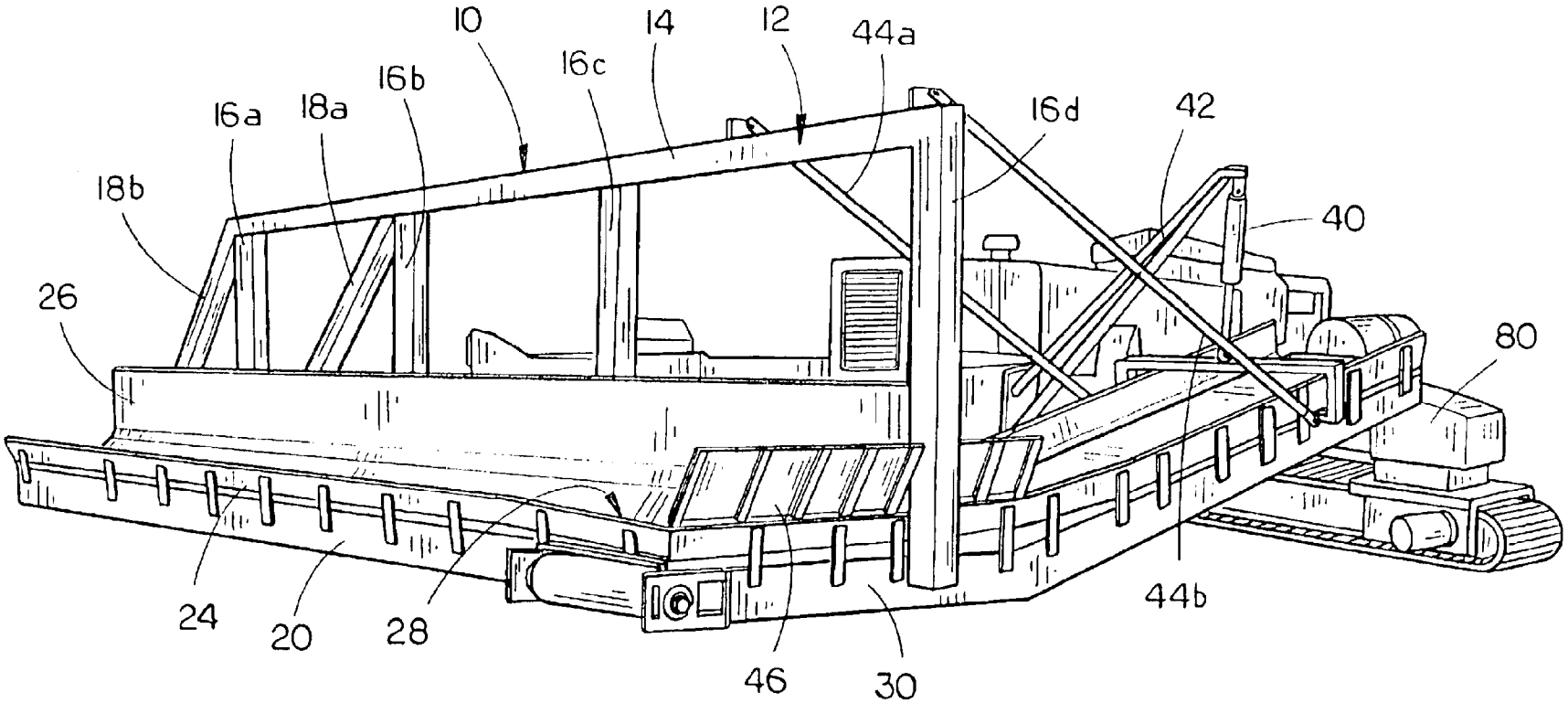
FIG. 2 is a perspective view of the side dump compatible material conveyor system of the present invention.
Figure 3:
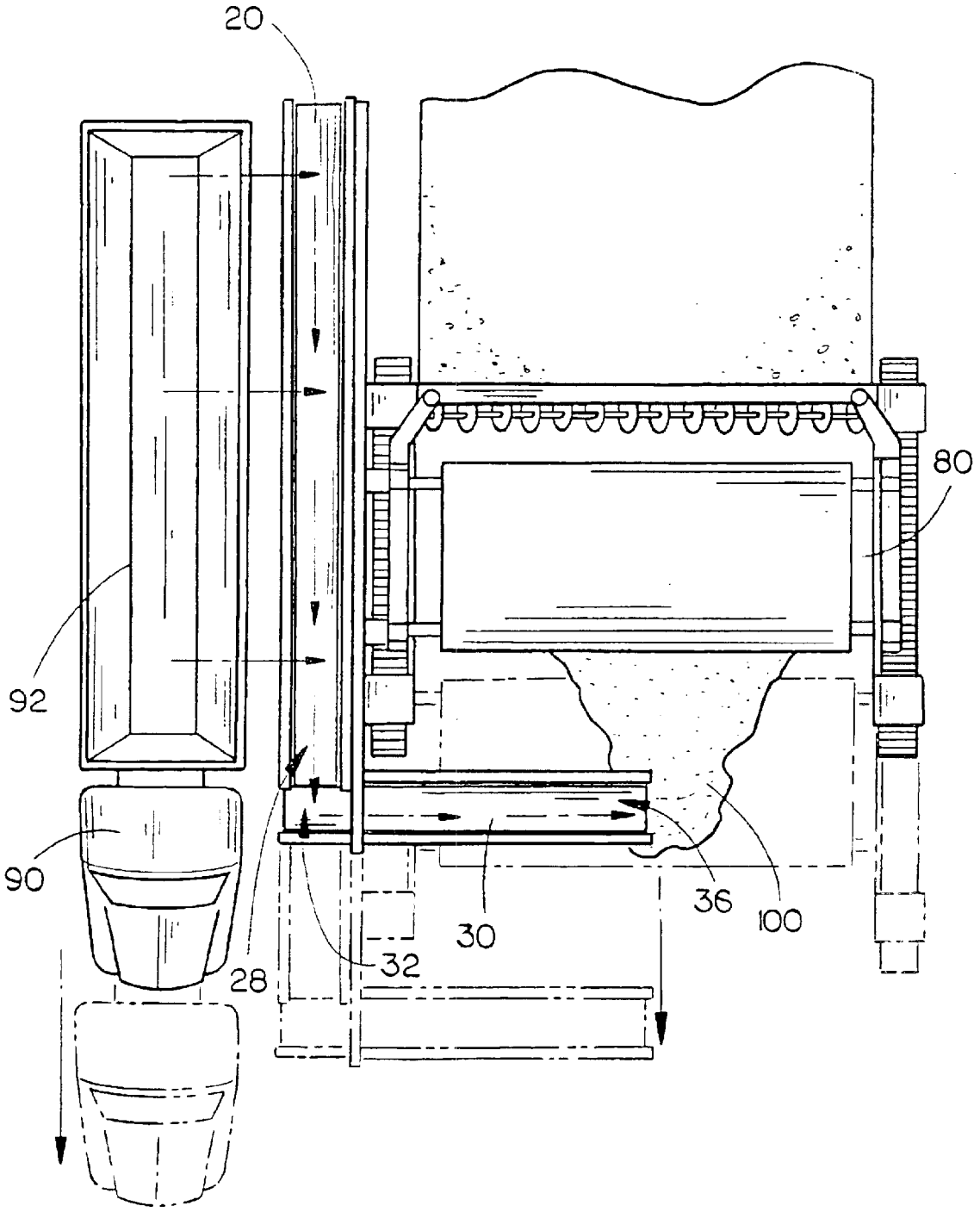
FIG. 3 is a top plan view of the present invention showing the direction of transfer of material from the side dump trailer dump tub to the material placer and spreader unit.

The side dump compatible material conveyor system 10 of the present invention is shown best in FIGS. 2 and 3 as including a conveyor support frame 12 adapted to be mounted on a placer/spreader unit 80. In the preferred embodiment, the conveyor support frame 12 would include a longitudinally extended main frame support beam 14 from which depend a plurality of generally upright frame struts 16*a,* 16*b,* 16*c,* and 16*d,* as shown best in FIG. 2. In the preferred embodiment, frame struts 16*b* and 16*c* would be connected to and mounted on the placer/spreader unit 80 and frame struts 16*a* and 16*d* function to support the remaining elements of the side dump compatible material conveyor system 10 as will be described below. Of course, it should be noted that the precise size, shape, and number of frame support beams 14 and frame struts 16*a–d* is not critical to the present invention so long as the elements of the invention are properly supported for material transfer. For example, it may be desirable to include one or more diagonal frame struts 18*a* and 18*b* to provide additional strength to the frame 12, particularly due to the extended length of the side dump compatible material conveyor system 10 of the present invention. Furthermore, although it is preferred that the conveyor support frame 12 be constructed of steel beams and the like, any appropriate construction material may be used with the present invention which provides the desired structural strength for the frame 12.

First conveyor belt 20 is best shown in FIGS. 2 and 3 as extending generally parallel with the direction of movement of the placer/spreader unit 80 and would preferably have a length of approximately 30 to 40 feet and a width of approximately twelve to seventy-two inches (12' to 72'), although these dimensions and all other dimensions discussed herein are not critical to the present invention so long as its functionality is maintained. First conveyor belt 20 includes a continuous rubberized belt 22 mounted on a plurality of support rollers (not shown) that are rotatably mounted generally perpendicular to the axis of travel of the belt 22. Although the first conveyor belt 20 is described as being a standard type of conveyor belt mechanism, it should be noted that various other types of conveyor systems may be substituted for the conveyor belts of the present invention so long as the intended purpose of transferring material along the belt is maintained. To facilitate transfer of material onto the first conveyor belt 20, an outer belt shield 24 and inner dump shield 26 are mounted on opposite sides of first conveyor belt 20 and extend generally parallel with the longitudinal axis of first conveyor belt 20, as shown best in FIGS. 2 and 3.

As material on the first conveyor belt 20 reaches the forward end 28 of the first conveyor belt 20, it is transferred onto second conveyor belt 30 which extends generally perpendicular to first conveyor belt 20, as shown best in FIGS. 2 and 3. The outer end 32 of second conveyor belt 30 is positioned adjacent to the forward end 28 of first conveyor belt 20 with the belt 34 of second conveyor belt 30 traveling in an inwards direction to transfer material from the outer end 32 of second conveyor belt 30 to the inner end 36. In the preferred embodiment, the inner end 36 of second conveyor belt 30 would be positioned above outer end 32 such that material would be moved "uphill" on second conveyor belt 30 to deposit the material being transferred in front of the placer/spreader unit 80. The height of inner end 36 of second conveyor belt 30 would preferably be adjustable by means of an hydraulic lift 40 mounted on a lift arm 42 extending from and connected to the placer/spreader unit 80, as shown best in FIG. 2. Finally, a pair of conveyor belt support rods 44*a* and 44*b* would preferably extend from main frame support beam 14 downwards to the inner end 36 of second conveyor belt 30 to provide additional support for the second conveyor belt 30 due to the expected weight of the material being transferred thereon. To further facilitate transfer of the material from first conveyor belt 20 to second conveyor belt 30, an additional material transfer shield 46 would preferably be mounted on second conveyor belt 30 adjacent the forward side thereof and extends generally perpendicular to the longitudinal axis of first conveyor belt 20 such that as material on first conveyor belt 20 reaches second conveyor belt 30, the inevitable "piling up" of material will not result in spillage of the material due to the material transfer shield 46. Finally, it should be noted that the second conveyor belt 30 need not extend generally perpendicular to the first conveyor belt 20 so long as the second conveyor belt 30 is operative to transfer material from the forward end 28 of first conveyor belt 20 to the front of the placer/spreader unit 80.

Figure 4:
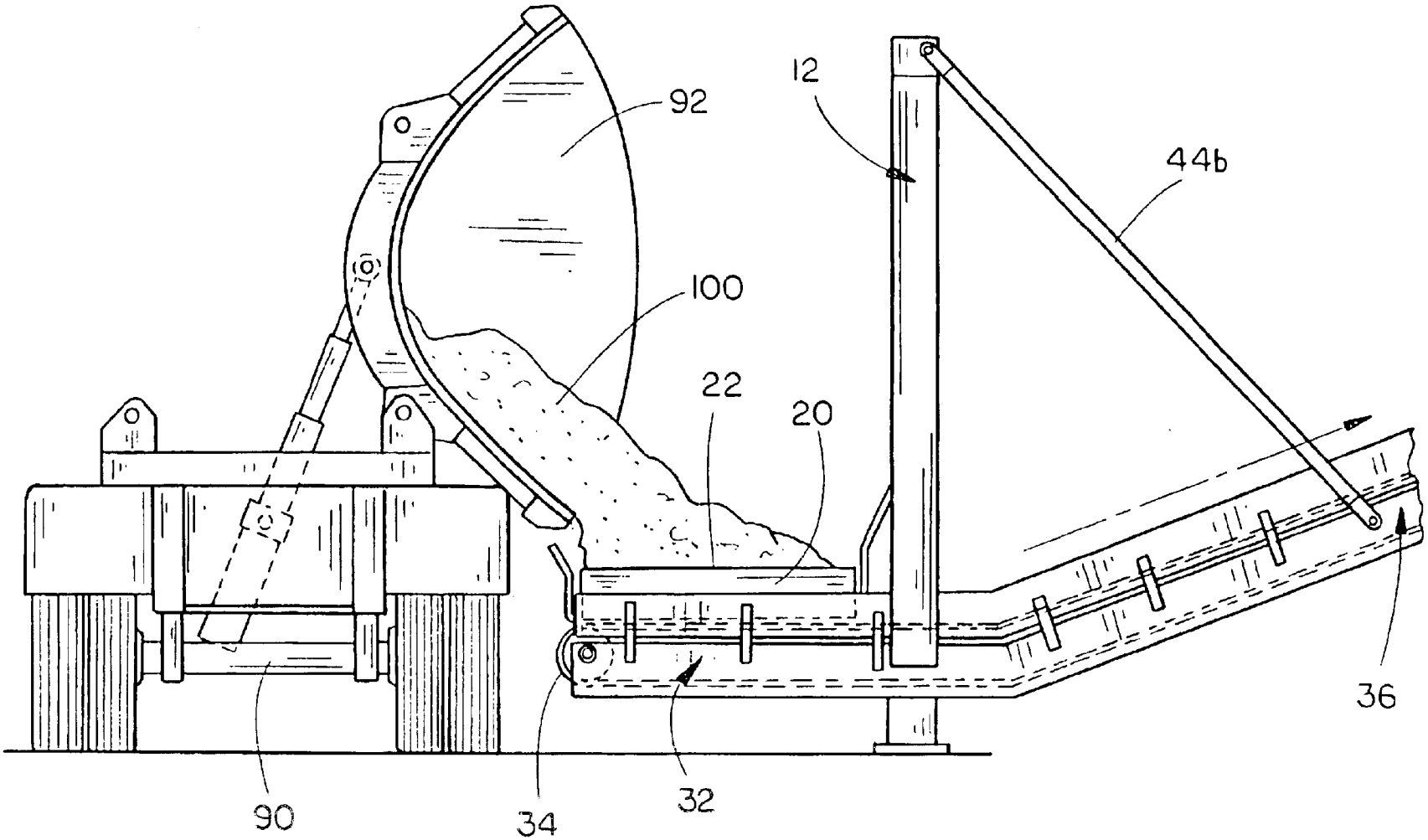
FIG. 4 is a front elevational view of the present invention showing the transfer of material from the side dump trailer (without the tractor unit attached to the trailer being shown) to the first conveyor belt and from there onto the second conveyor belt.

The side dump compatible material conveyor system 10 of the present invention operates in the following manner. As shown best in FIGS. 3 and 4, a side dump trailer 90 would approach the conveyor system 10 of the present invention and travel parallel with the direction of travel of the placer/spreader unit 80 in preparation for transfer of material to the material conveyor system 10 of the present invention. The material 100 held within the dump tub 92 of the side dump trailer 90 is then dumped onto the first conveyor belt 20 through the tilting and dumping of dump tub 92, as shown in FIG. 4. Because the material 100 is dumped out of dump tub 92 along the entire length thereof, transfer of the material 100 to the first conveyor belt 20 is accomplished much more easily and quickly than could possibly be accomplished using those conveyor mechanisms found in the prior art. As the material 100 is dumped onto first conveyor belt 20, the forward motion of belt 22 on first conveyor belt 20 transfers the material 100 forward towards the forward end 28 thereof and second conveyor belt 30. The presence of inner dump shield 26 and outer belt shield 24 cooperate to prevent accidental spillage of the material 100 during the dumping thereof and because the first conveyor belt 20 has a length which is longer than the length of dump tub 92, minor variations in speed between the placer/spreader unit 80 and side dump trailer 90 during the transfer of material 100 from dump tub 92 are easily accommodated without spillage of material.

As shown in FIG. 3, the side dump trailer 90 and placer/spreader unit 80 are both moving forward during the dumping of material 100 from dump tub 92, thus permitting continuous placing and spreading of the material 100 by the placer/spreader unit 80. Of course, it should be noted that either or both of the side dump trailer 90 and the placer/spreader unit 80 may be stationary during the material dump, as the extended length of first conveyor belt 20 will ensure that the material 100 is cleanly transferred from the side dump trailer 90 to the first conveyor belt 20. In any event, as the material 100 reaches the forward end 28 of first conveyor belt 20, it is transferred to the second conveyor belt 30 at the outer end 32 thereof and material transfer shield 46 prevents spilling of the material 100 during the belt-to-belt transfer. The material 100 is then transferred along second conveyor belt 30 towards the inner end 36 thereof on belt 34 with the hydraulic jack mechanism 40 controlling the height of inner end 36. As the material 100 reaches the inner end 36 of second conveyor belt 30, it is deposited in front of placer/spreader unit 80 in the precise desired location to permit use of the material 100 by the placer/spreader unit 80. A transfer of material 100 by the first conveyor belt 20 and second conveyor belt 30 continues until all of the material 100 dumped from dump tub 92 of side dump trailer 90 is transferred. The next side dump trailer would then approach the side dump compatible material conveyor system 10 of the present invention and proceed to dump its material onto the first conveyor belt 20, thus repeating the series of events and permitting continuous use of the placer/spreader unit 80 at a much higher rate of speed than permitted by those devices found in the prior art.

Of course, it should be noted that although the side dump compatible material conveyor system 10 of the present invention has been described as being mounted on the placer/spreader unit 80, it is entirely conceivable that it be mounted on a separate wheeled trailer or wheeled frame which could be connected to the placer/spreader unit 80 or driven separately therefrom to transfer material to the front of the placer/spreader unit 80. A precise connection between the placer/spreader unit 80 and side dump compatible material conveyor system 10 of the present invention is not critical so long as the operational characteristics of the side dump compatible material conveyor system 10 are maintained. Also, although the present invention has been described as being used to feed material to a placer/spreader unit 80, it may easily be used for many other purposes and in many other situations where the removal and transfer of material from a side dump trailer 90 is desired. For example, the user of the present invention may wish to stockpile material in a particular area and the present invention can be arranged to take the material from the side dump trailer 90 and deposit it in the intended stockpiling area.

It should be further noted that numerous modifications, additions and substitutions may be made to the side dump compatible material conveyor system 10 of the present invention which fall within the intended broad scope of the appended claims. For example, the precise size, shape and construction materials used in the present invention are not critical to the present invention so long as the intended functional characteristics are maintained. Also, although the present invention has been described as using conveyor belts, various other types of conveyor mechanisms may be substituted for the conveyor belts of the present invention depending on the material to be transferred and the intended speed and functional characteristics of the conveyor systems to be used, all of which would be understood by those skilled in the art. Finally, although the present invention has been described for use in connection with a placer/spreader unit 80, it may be used for and in connection with various other types of devices and construction machines depending on the needs and desires of the users of the present invention.

There has therefore been shown and described a side dump compatible material conveyor system which accomplishes at least all of its intended objectives.

I claim:

1. A side dump compatible material conveyor system operable to function with a material placer and spreader unit comprising:

a conveyor support frame including a longitudinally extended main frame support beam and a plurality of generally upright frame struts mounted on and extending from said main frame support beam each for connection to a selected one of said first conveyor belt means and said second conveyor belt means;

a first conveyor belt means mounted on said conveyor support frame;

a second conveyor belt means having outer and inner ends, said second conveyor belt means mounted on said conveyor support frame extending generally transverse to said first conveyor belt means with said outer end of said second conveyor belt positioned adjacent one end of said first conveyor belt means such that material moved on said first conveyor belt is transferred to said second conveyor belt means;

said inner end of said second conveyor belt means positionable in front of a material placer and spreader unit such that material moved on said second conveyor belt means towards said inner end thereof is deposited in front of a material placer and spreader unit for placing and spreading of the material.

2. The side dump compatible material conveyor system of claim 1 wherein said first conveyor belt means and said second conveyor belt means each comprise a belt mounted on a plurality of support rollers rotatably mounted and extending generally perpendicular to the axis of travel of said belt.

3. The side dump compatible material conveyor system of claim 1 wherein said first conveyor belt means further comprises an outer belt shield and an inner dump shield, said outer belt shield mounted on one side of said first conveyor belt means, said inner dump shield mounted on a side of said first conveyor belt means opposite said outer belt shield, each of said inner dump shield and said outer belt shield extending generally parallel with the longitudinal axis of said first conveyor belt means.

4. The side dump compatible material conveyor system of claim 1 wherein said second conveyor belt means further includes a material transfer shield mounted on said second conveyor belt means and extending generally parallel with the longitudinal axis of said second conveyor belt means, said material transfer shield operating such that as material on said first conveyor belt means reaches said second conveyor belt means, spillage of the material during the transfer from said first conveyor belt means to said second conveyor belt means is generally prevented.

5. The side dump compatible material conveyor system of claim 1 wherein said second conveyor belt means further comprises an inner end and an outer end, the height of said inner end being adjustable by a lift means operative to raise and lower said inner end.

6. The side dump compatible material conveyor system of claim 5 wherein said lift means comprises an hydraulic lift connected at one end to a lift arm and at the other end to said inner end of said second conveyor belt means for alternatively raising and lowering said inner end of said second conveyor belt means.

7. In combination:

a material placer and spreader unit having a body, movement means for moving said material placer and spreader unit at least in a forward direction and spreading means; and a conveyor support frame including a longitudinally extended main frame support beam and a plurality of generally upright frame struts mounted on and extending from said main frame support beam each for connection to a selected one of said first conveyor belt means and said second conveyor belt means mounted on said body of said material placer and spreader unit;

a first conveyor belt means mounted on said conveyor support frame and extending adjacent one side of said material placer and spreader unit;

a second conveyor belt means having outer and inner ends, said second conveyor belt means mounted on said conveyor support frame with said outer end of said second conveyor belt positioned adjacent one end of said first conveyor belt means such that material moved on said first conveyor belt is transferred to said second conveyor belt means;

said first conveyor belt means extending generally parallel with the direction of forward movement of said material placer and spreader unit, said second conveyor belt means extending generally transverse to said direction of forward movement of said material placer and spreader unit such that side dump trailers unloading material onto said first conveyor belt means are operable to be moving forwards with said material placer and spreader unit during the material unloading process;

said inner end of said second conveyor belt means positioned in front of said material placer and spreader unit such that material moved on said second conveyor belt means towards said inner end thereof is deposited in front of said material placer and spreader unit for engagement by said spreading means of said material placer and spreader unit for placing and spreading of the material.

8. A side dump compatible material conveyor system operable to transfer material from a side dump trailer comprising:

a conveyor support frame;

a first conveyor belt means mounted on said conveyor support frame;

a second conveyor belt means having outer and inner ends, said second conveyor belt means mounted on said conveyor support frame extending generally transverse to said first conveyor belt means with said outer end of said second conveyor belt positioned adjacent one end of said first conveyor belt means such that material moved on said first conveyor belt is transferred to said second conveyor belt means;

said first and second conveyor belt means mounted on a movable vehicle operable for forward movement for movement of said first and second conveyor belt means, said first conveyor belt means extending generally parallel with the direction of forward movement of said movable vehicle, said second conveyor belt means extending generally transverse to said direction of forward movement of said movable vehicle; and said inner end of said second conveyor belt means positionable such that material moved on said second conveyor belt means towards said inner end thereof is deposited in a selected location for use thereof.

9. The side dump compatible material conveyor system of claim 8 wherein said first conveyor belt means and said second conveyor belt means each comprise a belt mounted on a plurality of support rollers rotatably mounted and extending generally perpendicular to the axis of travel of said belt.

10. The side dump compatible material conveyor system of claim 8 wherein said first conveyor belt means further comprises an outer belt shield and an inner dump shield, said outer belt shield mounted on one side of said first conveyor belt means, said inner dump shield mounted on a side of said first conveyor belt means opposite said outer belt shield, each of said inner dump shield and said outer belt shield extending generally parallel with the longitudinal axis of said first conveyor belt means.

11. The side dump compatible material conveyor system of claim 8 wherein said second conveyor belt means further includes a material transfer shield mounted on said second conveyor belt means and extending generally parallel with the longitudinal axis of said second conveyor belt means, said material transfer shield operating such that as material on said first conveyor belt means reaches said second conveyor belt means, spillage of the material during the transfer from said first conveyor belt means to said second conveyor belt means is generally prevented.

12. The side dump compatible material conveyor system of claim 8 wherein said second conveyor belt means further comprises an inner end and an outer end, the height of said inner end being adjustable by a lift means operative to raise and lower said inner end.

13. The side dump compatible material conveyor system of claim 12 wherein said lift means comprises an hydraulic lift connected at one end to a lift arm and at the other end to said inner end of said second conveyor belt means for alternatively raising and lowering said inner end of said second conveyor belt means.

14. The side dump compatible material conveyor system of claim 8 wherein the length of said first conveyor belt means is greater than the length of said second conveyor belt means.

* * * * *